US006379264B1

(12) United States Patent
Forzano

(10) Patent No.: US 6,379,264 B1
(45) Date of Patent: Apr. 30, 2002

(54) PUTTER

(76) Inventor: Richard Forzano, 46 Newman Rd., Wantage, NJ (US) 07461

( * ) Notice: Subject to any disclaimer, the term of this patent is extended or adjusted under 35 U.S.C. 154(b) by 0 days.

(21) Appl. No.: 09/310,111

(22) Filed: May 12, 1999

Related U.S. Application Data

(60) Provisional application No. 60/111,157, filed on Dec. 17, 1998.

(51) Int. Cl.[7] ..... A63B 53/06

(52) U.S. Cl. ..... 473/336; 473/340

(58) Field of Search ..... 473/334, 335, 473/336, 337, 338, 339, 340, 341, 330, 331, 349, 256; D21/736

(56) References Cited

U.S. PATENT DOCUMENTS

| | | | | |
|---|---|---|---|---|
| 1,531,821 | A | * | 3/1925 | Scott |
| 1,536,616 | A | * | 5/1925 | Manning |
| 2,155,830 | A | * | 4/1939 | Howard |
| 3,893,672 | A | * | 7/1975 | Schonher |
| D248,181 | S | * | 6/1978 | Cervantes |
| 4,325,553 | A | * | 4/1982 | Taylor |
| 4,413,825 | A | * | 11/1983 | Sasse |
| 4,530,505 | A | * | 7/1985 | Stuff |
| 4,869,507 | A | * | 9/1989 | Sahm |
| 5,026,056 | A | | 6/1991 | McNally et al. |
| 5,244,210 | A | | 9/1993 | Au |
| 5,253,869 | A | * | 10/1993 | Dingle |
| 5,390,919 | A | | 7/1995 | Stubbs et al. |
| 5,435,559 | A | | 7/1995 | Swisshelm |
| 5,460,377 | A | * | 10/1995 | Schmidt |
| D370,517 | S | | 6/1996 | Butler, Jr. |
| 5,683,309 | A | | 11/1997 | Reimers |
| 5,709,616 | A | * | 1/1998 | Rife |
| 5,769,737 | A | * | 6/1998 | Holladay |

FOREIGN PATENT DOCUMENTS

| | | | | |
|---|---|---|---|---|
| GB | 25564 | * | 12/1905 | ..... 273/175 |

* cited by examiner

*Primary Examiner*—Sebastiano Passaniti
(74) *Attorney, Agent, or Firm*—Richard L. Aitken; Venable

(57) ABSTRACT

In a putter, adjustable weights are provide which can be moved to different positions longitudinally along the putter head. The putter head is provided with a channel and the adjustable weights include a slide which slides in the channel. The channel communicates with a slot and studs project through the slot and screw into the slides to tighten the knobs against the putter head to hold the slidable weights in position. The front face of the putter is provided with vertical grooves at a pitch of about 16 grooves per inch with the grooves and the lands between the grooves being of equal width.

8 Claims, 4 Drawing Sheets

PUTTER

CROSS REFERENCE TO RELATED APPLICATION

This application claims the benefit of Provisional Application Ser. No. 60/111,157, filed Dec. 17, 1998.

BACKGROUND OF THE INVENTION

This invention relates to adjustable golf equipment and more particularly to a putter with an adjustable sweet spot and having a construction facilitating adjustment of the putter to compensate for a golfer's tendency to miss putts by misdirection.

Many different kinds and shapes of putters are available on the market and new putter models are continuously being developed. One putter in the prior art employs adjustable weights to enable the sweet spot in the putter to be adjusted along the axis of the putter head. In this particular prior art putter, adjustable weights are screwed into a weight chamber extending from the heel to the toe of the putter and the threaded chamber is closed with threaded end plugs. The weights and the end plugs are provided with slots to receive a screw driver to enable adjustment of the weights. The above described putter of the prior art enables the sweet spot to be adjusted, but it requires use of a tool, a screw driver, and the weight adjustment is time consuming. Since to find a sweet spot on a putter would mostly be by trial and error, the adjustment of the weights requiring removal of the threaded end caps, adjustment of the weight position by screwing, and then screwing the threaded end caps back into the putter head, the finding of the correct sweet spot by trial and error with the above-described putter is a tedious task.

SUMMARY OF THE INVENTION

The present invention overcomes the problem of the prior art adjustable sweet spot putter by providing adjustable weights which are designed to permit a sliding motion in a channel which runs longitudinally within the putter head. The weights comprise knobs provided with integral threaded studs which screw into slides. The slides slide in the channel and the threaded studs extend through a slot or slots communicating with the channel. The knobs are tightenable against the side surfaces of the slot to hold the weights in their selected position. The knobs are structured to make them finger tightenable and also to enable them to be loosened from their tightened condition by means of the fingers to facilitate sliding the weight to a new position. In an alternative embodiment, the weights are not slidable but are adjustable by changing the weight to different values.

The face of the putter is provided with small vertical grooves which improve the consistency of the contact of the putter face with the dimpled ball surface to give the golf ball struck with the putter face more consistency in its direction.

BRIEF DESCRIPTION OF THE PREFERRED EMBODIMENT

Figure 1:
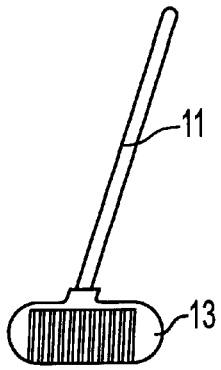
FIG. 1 is a view in elevation of the putter of the invention.
Figure 2:
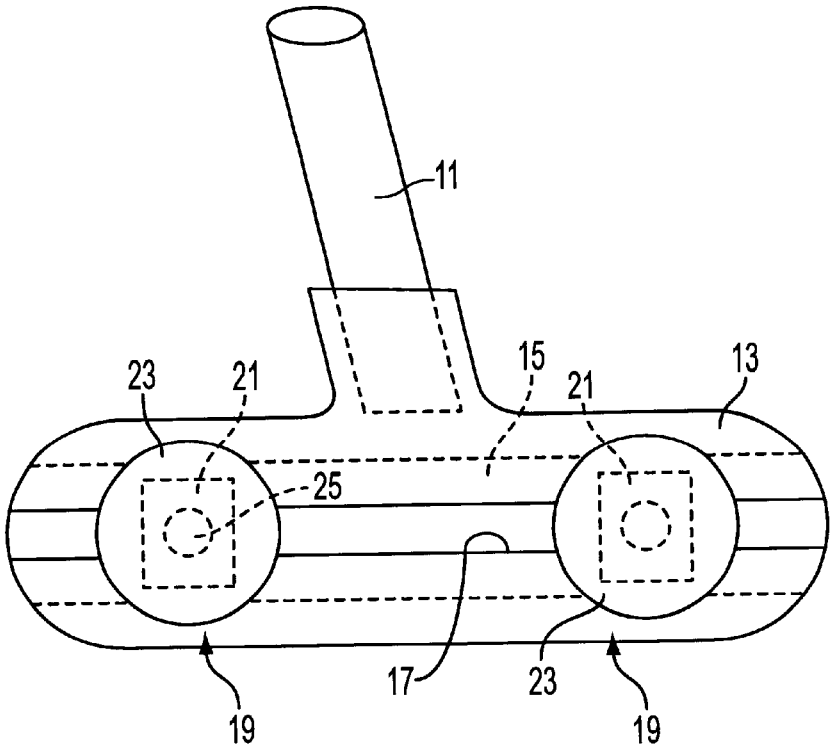
FIG. 2 shows an enlarged view in elevation of the back side of the putter head of the putter shown in FIG. 1.
Figure 3:
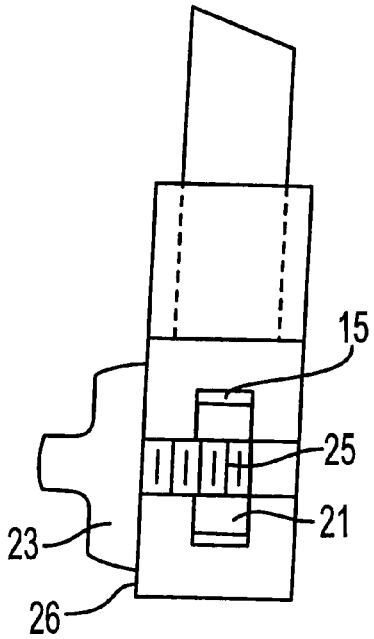
FIG. 3 is an enlarged end view of the putter head shown in FIGS. 1 and 2.

As shown in FIG. 1, the putter comprises a head 13 having an elongated shape and fixed to a shaft 11 typically about 36 inches in length, but may be considerably longer for putters using the pendulum separated hands style of putting currently used by Rocco Mediate on the PGA golf tour. The putter head 13 as shown in FIGS. 2 and 3 defines a hollow, longitudinal channel 15 extending lengthwise throughout the length of the putter head. The channel 15 communicates with a slot 17 centered on the channel and extending throughout most of the length of the channel. Weights 19 are mounted to be slidable in the channel. The weights each comprise a slide 21 which is preferably shaped to have extended flat upper and lower surfaces to facilitate sliding in the channel 14. In the specific embodiment shown in FIG. 2, the slides are rectangular as viewed in elevation and rectangular in vertical cross section to make the slide 21 readily slidable in the channel 15, which is also rectangular when viewed in cross section. Alternatively, the slides may be hex nuts. The weights 19 further comprise knobs 23 which are made of one piece with threaded studs 25, which screw into threaded holes in the slides 21. A slide 21, a knob 23 and a stud 25 together comprise a slidable weight. When the knobs 23 are turned to screw the studs 21 into the slides, they tighten against the outside surface 26 of the putter defining the slot 17 and fixedly hold the weights in position. To slide a weight to a new position, the knob is turned on the stud to loosen the engagement with the surface 26 enabling the weight to be easily slid to a new position along the channel.

Figure 4:
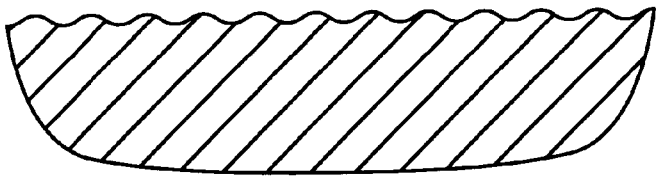
FIG. 4 is an enlarged view of a broken away section of the putter head taken horizontally at the front face of the putter.
Figure 5:
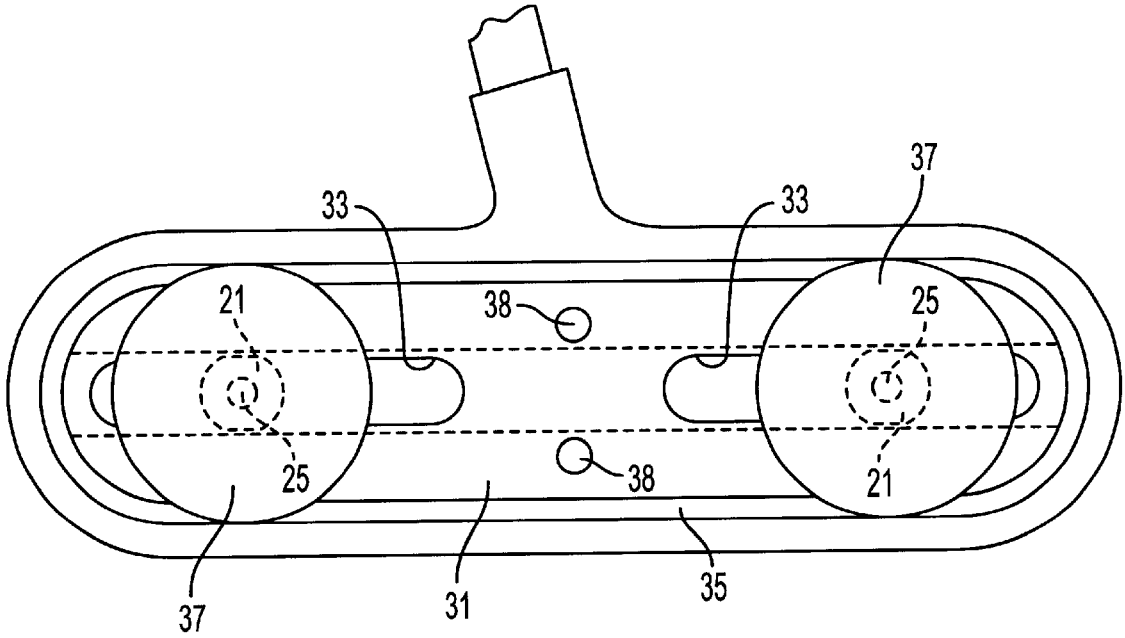
FIG. 5 is an enlarged view of the back face of a putter head of another embodiment of the putter of the invention.
Figure 6:
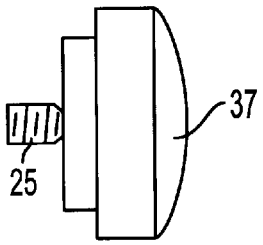
FIG. 6 is a side view in elevation of one of the knobs assembled with a threaded stud for the embodiment of FIG. 5.
Figure 7:
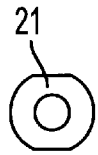
FIG. 7 is a view in elevation of a slide for the embodiment of FIG. 5.
Figure 8:
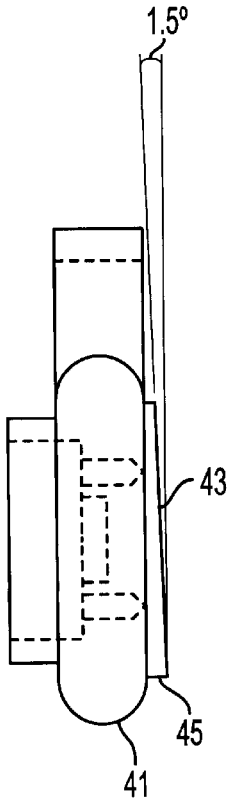
FIG. 8 is an end view in elevation of the putter head of the embodiment of FIG. 5.

The front surface of the putter head which strikes the ball is provided with vertical grooves 30, 16 per inch, in a sawtooth contour with slightly rounded peaks, as shown in FIG. 4. The grooves are distributed over 5.315 inches horizontally in the front face and are 0.015 inches deep and have a concave curvature on a 0.03 inch radius. The vertical grooves tend to propel the ball more consistently in the direction of the motion of the club face than a putter with a flat stiking surface. The reason for this improvement is that a golf ball is not round, but has dimples, and a perfectly flat club face will initially make contact with the ball only at one point. This point may be on a land between dimples, it may be in the middle of a dimple or it may be on the corner between the dimple and a land. When the club face strikes the ball at a comer between a dimple and a land, there is a tendency for the ball to be impelled slightly offline from the motion of the club. The grooves in the club face of the invention reduce this problem because the grooves tend to bridge across the dimples and tend to make initial contact with the ball at two points rather than one. The groove pitch, groove shape, and groove width are selected so that the putter is effective to more consistently impel a ball struck by the grooved putter face in the direction of motion of the putter head when the direction of motion is perpendicular to the plane of the front face.

A second embodiment of the invention is illustrated in FIGS. 5–8. In this embodiment, the channel which contains the slides is defined by an open channel 15 rectangular in cross section defined in the back of the putter head body and the channel 15 is closed by a brass plate 31. The brass plate defines two aligned oval slots 33 centered over the channel 15 so that the slides 21 are slidably captured within the channel 15 with the studs 25 screwed into the slides each extending through a different slot 33. The plate fits in a recess defined by the oval shaped ridge 35. The knobs of the weights in this embodiment are designated by the reference number 37 and may be knurled to facilitate turning of the knobs to screw and unscrew the studs in the slides 21. The slides in this embodiment as viewed in elevation have round end surfaces and flat upper and lower surfaces to guide the sliding action in the channel 15. In this embodiment, the front face of the putter is lofted at a 1.5 degree angle. The putter head in this embodiment is made out of aluminum and the plate 31 is brass. The plate 31 is screwed to the putter body by means of 6 Phillips head brass screws 38. The front face of the putter is grooved as in the first embodiment. The grooved front face combined with the 1.5 degree loft provides a truer spin on the ball leaving the club head upon being struck by the club head. The bottom surface 41 of the club head is rounded in a circular curve from the back face of the club head to the front face. The rounding of the bottom surface 41 reduces the chance of the front face of the putter picking up stray grass blades. The grooves on the front face of the putter are formed in a raised surface 43 which is the operative front face of the putter. It is the raised front face 43 that is lofted at the 1.5 ° angle. The bottom edge 45 of raised front face 43 is located at 0.375 inches above the bottom surface 41 of the club head. The normal putting stroke leaves a 0.3 inch gap between the bottom surface of the putter club head and the putting surface. If the golf ball to be putted is on the green, but is tucked up against the fringe at the edge of the green, the raised front face spaced about 0.25 inches above the rounded bottom surface 41 gives a cleaner stroke at the ball overcoming the disadvantage of the ball being positioned against the fringe.

Figure 9:
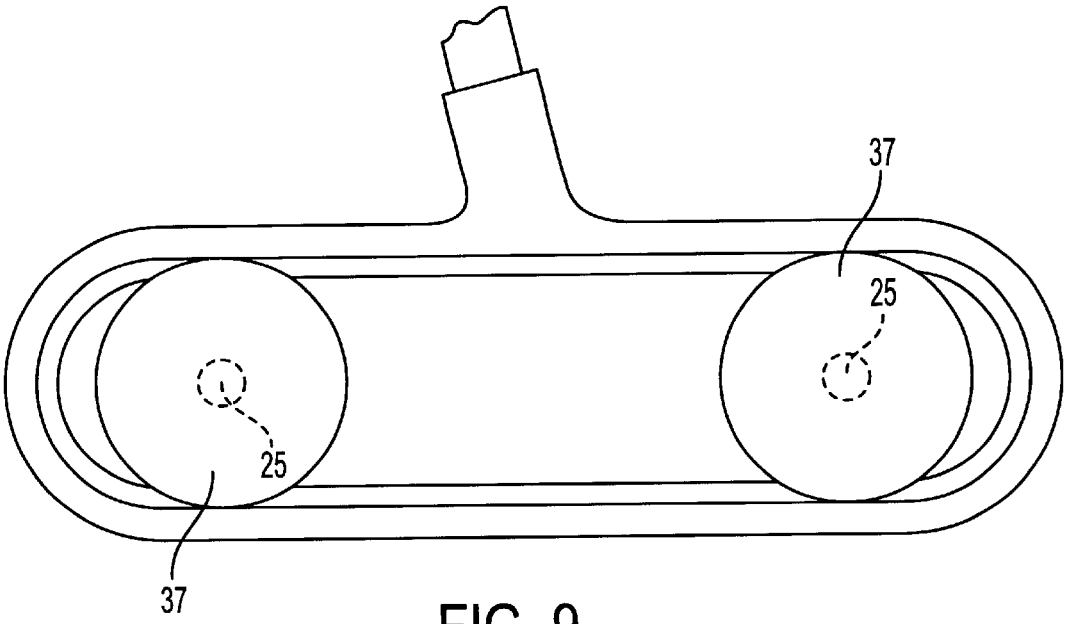
FIG. 9 is a view in elevation of the back face of the putter of another embodiment of the invention in which the weights are not slidable but which can be changed to different weight values.

In the embodiment of FIG. 9, instead of making the weights slidable, two sets of weights 37 ranging in weight value from 1.8 ounces to 2.8 ounces are provided. Each weight of the two sets comprises a knob with a threaded stud like the knob shown in FIG. 5, and each can be screwed into a tapped hole formed in the back of the putter face. By changing the weight to a different weight value, the golfer can adjust the location of the sweet spot and can also adjust the swing weight of the putter to suit his putting stroke.

The above description is of preferred embodiments of the invention and modifications may be made thereto without departing from the spirit and scope of the invention which is defined by the appended claims.

What is claimed is:

1. A putter head and a shaft fixed to said putter head, said putter head defining a channel rectangular in cross section and extending longitudinally in said putter head and opening to the back side of said putter head, a plate fixed to said putter head and covering the opening to said channel at the back side of said putter head, a slot defined in said plate in communication with said channel and extending parallel to said channel, and a weight slidably mounted in said channel and adapted to be tightened against said plate to hold said weight in position, said weight comprising a slide shaped to slide within said slot, an external weight portion outside of said channel, and connecting means extending through said slot to releasably hold said slide and said external weight portion tightly together sandwiching said plate to hold said weight in position.

2. A putter as recited in claim 1, wherein said connecting means comprises a stud connected to said slide, and said external weight portion comprises a knob connected to said stud and tightenable against said plate to hold the weight in position.

3. A putter as recited in claim 2, wherein said studs are threaded and are screwed into said slides to enable said knobs to be tightened against said plate.

4. A putter as recited in claim 2, wherein said knobs are tightenable against the back face of said putter.

5. A putter as recited in claim 2, wherein said knobs have knurled surfaces.

6. A putter as recited in claim 1, wherein the front face of said putter head defines vertical grooves constructed and sized to cause a dimpled golf ball struck by said front surface to more consistently be impelled in the direction of movement of said putter head when said movement is perpendicular to said front face.

7. A putter as recited in claim 6, wherein said grooves are at a pitch of about 16 grooves per inch.

8. A putter as recited in claim 1, wherein a second slot is defined in said plate longitudinally aligned with said first slot and spaced from said first slot, a second weight slidably mounted in said channel and adapted to be tightened against said plate to hold said second weight in position, said second weight comprising a second slide shaped to slide within said channel, a second external weight portion outside of said channel, and a second connecting means extending through said second slot to releasably hold said second slide and said second external weight portion together sandwiching said plate to hold said second weight in position.

* * * * *